US011401773B1

(12) United States Patent
Arshad et al.

(10) Patent No.: US 11,401,773 B1
(45) Date of Patent: Aug. 2, 2022

(54) COMPENSATING CHANGES IN LENGTH OF A WELLBORE STRING

(71) Applicant: Saudi Arabian Oil Company, Dhahran (SA)

(72) Inventors: Waheed Arshad, Mississauga (CA); Mohammad H. Altwaijri, Dhahran (SA); Ahmed M. Al-Omair, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/195,528

(22) Filed: Mar. 8, 2021

(51) Int. Cl.
*E21B 33/12* (2006.01)
*E21B 33/124* (2006.01)
*E21B 23/06* (2006.01)

(52) U.S. Cl.
CPC ..... *E21B 33/1243* (2013.01); *E21B 33/12* (2013.01); *E21B 23/06* (2013.01)

(58) Field of Classification Search
CPC ..... E21B 33/12; E21B 33/1243; E21B 23/06
See application file for complete search history.

(56) References Cited

U.S. PATENT DOCUMENTS 7,144,243 B2 * 12/2006 Stephenson ..... E21B 43/105 166/380
7,757,774 B2 7/2010 Ring
8,800,650 B2 8/2014 Spray et al.
11,175,119 B2 * 11/2021 Patching ..... F42D 1/08
11,208,869 B2 * 12/2021 Roane ..... E21B 43/26
2016/0053591 A1 2/2016 Hallundbaek et al.

FOREIGN PATENT DOCUMENTS

CA 2579116 8/2007

OTHER PUBLICATIONS

Chen et al., "Case Study: Casing Deformation Caused by Hydraulic Fracturing—Induced Fault Slip in the Sichuan Basin," URTeC: 2882313, presented at the Unconventional Resources Technology Conference, Houston, Texas, Jul. 23-25, 2018, 9 pages.
Furui et al, "A Comprehensive Modeling Analysis of Borehole Stability and Production-Liner Deformation for Inclined/Horizontal Wells Completed in a Highly Compacting Chalk Formation," Society of Petroleum Engineers, 2010, 14 pages.
(Continued)

*Primary Examiner* — Yong-Suk (Philip) Ro
(74) *Attorney, Agent, or Firm* — Fish & Richardson P.C.

(57) ABSTRACT

A wellbore assembly includes a first tube and a second tube. The first tube is disposed within a wellbore and has a first end fixed with respect to a wall of the wellbore. The second tube is coupled to a second end of the first tube. The second tube has a third end opposite the coupling and fixed with respect to the wall of the wellbore. The first tube includes a portion of reduced or increased diameter residing between the first end and the second end. The portion of reduced or increased diameter defines an internal diameter that changes, with the first tube under a compression load, to decrease a length of the first tube. The internal diameter changes, with the first tube under a tensile load, to increase a length of the first tube to accommodate changes in length of the first tube or the second tube or both.

20 Claims, 4 Drawing Sheets

(56) References Cited

OTHER PUBLICATIONS

Hammerlindl, "Basic Fluid and Pressure Forces on Oilwell Tubulars," J Pet Technol, Jan. 1980, 32(1):153-159.
Hammerlindl, "Packer-to-Tubing Forces for Intermediate Packers," J Pet Technol, Mar. 1980, 32(3):515-527.
Kang et al., "Force Calculation with Oil Well Packer: A Revisit," presented at the International Petroleum Technology Conference, Dhahran, Saudi Arabia, Jan. 13-15, 2020, 16 pages.
Xu et al., "Mechanism Study of Casing Deformation in Multistage Hydraulic Fracturing Shale Reservoir," URTeC: 2886020, presented at the Unconventional Resources Technology Conference, Houston, Texas, Jul. 23-25, 2018, 8 pages.
Zhang et al., Stress Redistribution Analysis in Multiple Eccentric Packers During Completion Operations, SPE-166145, presented at the SPE Annual Technical Conference Exhibition, New Orleans, Louisiana, Sep. 30-Oct. 2, 2013, 9 pages.
Zhao et al., "The Casing Deformation During Shale Gas Hydraulic Fracturing: Why it is so Serious in Weiyuan-Changning, China," SPE-191273-MS, presented at the SPE Trinidad and Tobago Section Energy Resources Conference, Port of Spain, Trinidad and Tobago, Jun. 25-26, 2018, 14 pages.

* cited by examiner

COMPENSATING CHANGES IN LENGTH OF A WELLBORE STRING

FIELD OF THE DISCLOSURE

This disclosure relates to wellbores, in particular, to wellbore tools.

BACKGROUND OF THE DISCLOSURE

Wellbores are constructed and prepared for production by first drilling and then by deploying casing into the wellbore and cementing the casing into place. Completion strings are deployed within a wellbore to perform production, testing, and hydraulic fracturing operations. In other types of completion design the liner or casing is run into the wellbore but is not cemented in place. The liner is suspended in the openhole and is held in place by using openhole packers. This liner assembly which includes packers and stage tools and lies in the openhole section of the wellbore is known as the lower completion string. These free-standing, openhole, multi-stage completions can be subject to large axial loads during hydraulic fracturing operations when significant changes in temperature and pressure are experienced by the string. Methods and equipment to compensate for such changes are sought.

SUMMARY

Implementations of the present disclosure include a wellbore assembly that includes a first tube and a second tube. The first tube is disposed within a wellbore. The first tube has a first end is fixed against substantial movement with respect to a wall of the wellbore. The second tube is coupled to a second end of the first tube opposite the first end, forming a coupling with the first tube. The second tube has a third end opposite the coupling. The third end is fixed against substantial movement with respect to the wall of the wellbore. The first tube includes a portion of reduced or increased diameter residing between the first end and the second end. The portion of reduced or increased diameter defining an internal diameter that changes, with the first tube under a compression load, to decrease a length of the first tube. The internal diameter changes, with the first tube under a tensile load, to increase a length of the first tube such that the portion of reduced or increased diameter accommodates changes in length of the first tube or the second tube or both.

In some implementations, the portion of reduced or increased diameter include a portion of reduced diameter. The internal diameter increases, with the first tube under a compression load, to decrease a length of the first tube, and the internal diameter decreases, with the first tube under a tensile load, to increase a length of the first tube.

In some implementations, the portion of reduced or increased diameter is disposed between a first wall of the first tube and a second wall of the first tube. The second wall defines a substantially equal inner diameter than an inner diameter of the first wall. The portion of reduced or increased diameter bends or flexes under axial stress to reduce or increase the length of the first tube.

In some implementations, the first wall and the second wall include an internal diameter that remains substantially constant during changes in length of the first tube.

In some implementations, the portion of reduced or increased diameter includes an inwardly-projecting annular pleat that bends outwardly under an axial compression load applied by the second tube increasing in length. The inwardly-projection annular pleat bends inwardly under an axial tensile load applied by the second tube decreasing in length.

In some implementations, the inwardly-projecting annular pleat includes a length that changes, under axial stress, between 2% and 4%, and the internal diameter of the annular pleat varies between 2% to 4%.

In some implementations, the first tube includes a plurality of inwardly-projecting annular pleats arranged along a length of the first tube. Each inwardly-projecting annular pleat includes a respective variable diameter to change a length of the first tube.

In some implementations, the inwardly-projecting annular pleat includes a curved wall with a portion diverging toward a center of the curved wall with respect to a direction of a fluid flowing along the first tube, and a second portion converging away from the center with respect to the direction of the fluid flowing along the first tube.

In some implementations, the portion of reduced or increased diameter is made of a metal including an expandable tubular metallurgy.

In some implementations, the wellbore assembly further includes a first packer coupled to the first end of the first tube and a second packer coupled to the third end of the second tube. The first packer isolates, with the second packer, an annulus defined between the first packer and the second packer from a wellbore annulus uphole of the first packer. The first packer fixes the first end of the first tube to the wall of the wellbore and the second packer fixes the third end of the second tube to the wall of the wellbore. In some implementations, the first packer includes a first open hole isolation packer, the second packer includes a second open hole isolation packer, and the first tube and the second tube are part of an open hole multistage completion string, the second tube coupled, though a frac sleeve of the open hole multistage completion string, to the second end of the first tube.

In some implementations, the open hole multistage completion string is disposed within a non-vertical section of the wellbore, each of the first open hole isolation packer and the open hole second isolation packer is set on an open hole portion of the non-vertical section of the wellbore to prevent the respective ends of the first tube and the second tube from substantially moving with respect to the wall of the wellbore.

In some implementations, the first tube includes multiple portions of reduced or increased diameter. One of the plurality of portions of reduced or increased diameter includes an inwardly-projection pleat, and one of the plurality of portions of reduced or increased diameter including an outwardly-projecting pleat.

Implementations of the present disclosure include a method that includes obtaining a wellbore assembly that includes a first tube disposed within a wellbore. The first tube including a first end and a second end opposite the first end. The first tube has a portion of reduced or increased diameter residing between the first end and the second end. The portion of reduced or increased defines an internal diameter that changes, under an axial load, to change a length of the first tube. The wellbore assembly also includes a second tube. The method also includes coupling the first tube to the second tube. The method also includes deploying the first tube and the second tube to a downhole section of a wellbore. The method also includes setting the first tube and the second tube on the wall of the wellbore such that the first tube changes in length, upon being subject to an axial load applied at the first end, and an opposite axial load applied at the second end by the second tube changing in length.

In some implementations, setting the first tube and the second tube on the wall includes setting a first packer and a second packer on the wall of the wellbore. The first packer is coupled to the first tube and the second packer coupled to the second tube. The first tube decreases in length under an axial compression load applied by the second tube increasing in length. The first tube increases in length under an axial tensile load applied by the second tube decreasing in length.

In some implementations, the first packer includes a first open hole isolation packer. The second packer includes a second open hole isolation packer. The first tube and the second tube are part of an open hole multistage completion string. Coupling the first tube to the second tube includes coupling the first tube to first end of a frac sleeve and coupling the second tube to a second end of the frac sleeve.

In some implementations, setting the first packer and the second packer includes setting the first packer on a non-vertical, open hole section of the wellbore and setting the second packer on the non-vertical, open hole section of the wellbore.

In some implementations, the inwardly-projecting annular pleat and the internal diameter of the annular pleat varies between 2% to 4%, and setting the first tube on the wall of the wellbore includes setting the tube such that the annular pleat varies in length between 2% to 4% under axial stress applied by the second tube changing in length.

In some implementations, the first tube includes a plurality of portions of reduced or increased diameter. One of the plurality of portions of reduced or increased diameter includes an inwardly-projection pleat, and one of the plurality of portions of reduced or increased diameter including an outwardly-projecting pleat. Setting the first tube on the wall of the wellbore includes setting the tube such that the first tube varies in length between 2% to 4% per pleat under axial stress applied by the second tube changing in length.

DETAILED DESCRIPTION OF THE DISCLOSURE

Figure 1:
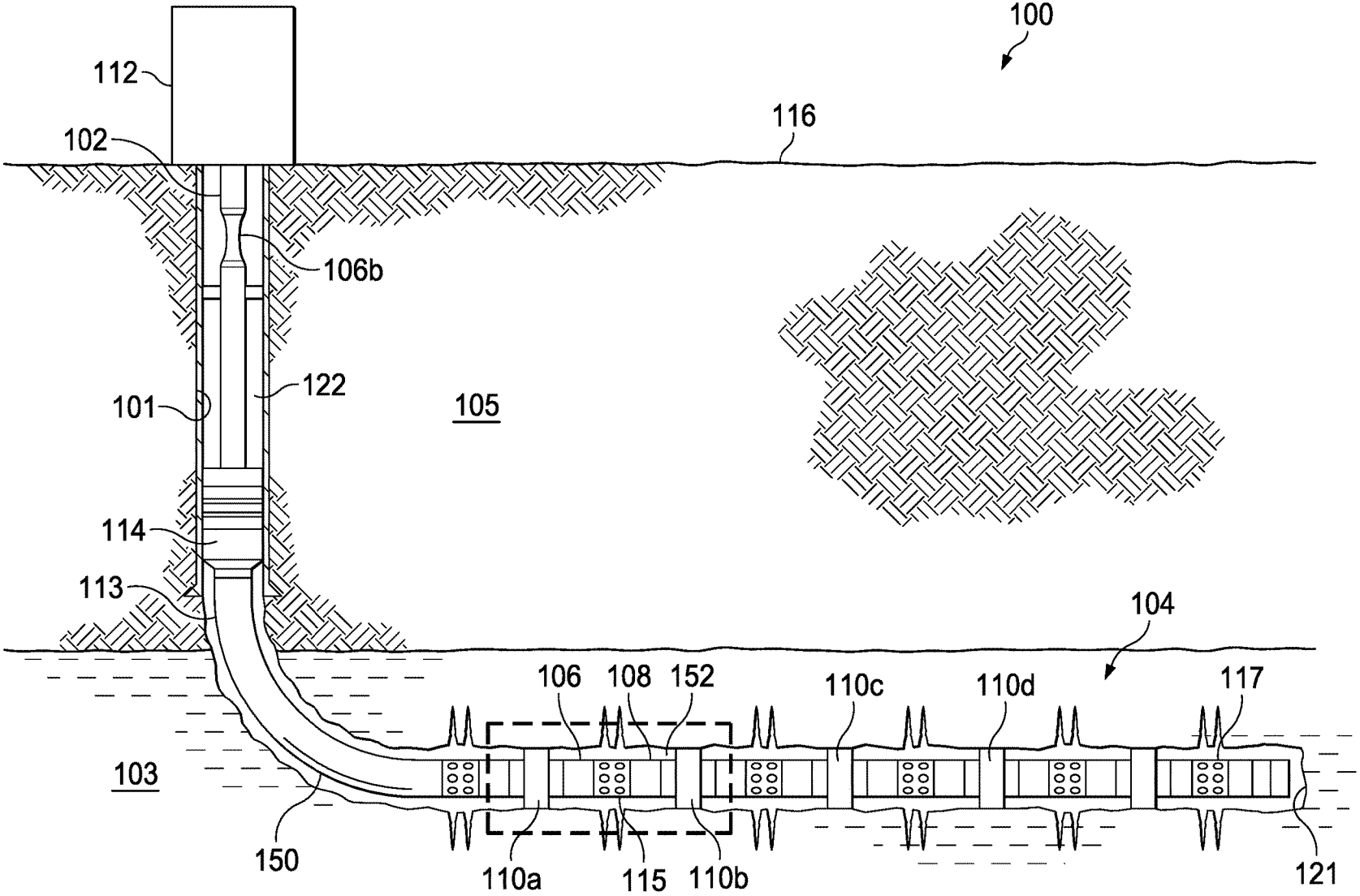
FIG. 1 is a front schematic view of a wellbore assembly according to implementations of the present disclosure.

The present disclosure describes a compensator tube (e.g., a stress compensator) of variable length to accommodate changes in length of a lower multistage completion string. Lower multistage completion strings experience deformation in certain sections of the liner during or after fracturing operations. Pipe deformation can affect the wellbore integrity resulting in a loss of tubing drift along the wellbore and in some cases pipe rupture. The compensator tube is made from a special expandable tubular metallurgy that can accommodate length changes in the lower completion by stretching or contracting without allowing the entire lower completion to deform. The compensator tube has one or more small sections of reduced diameter that adjust in diameter by distending laterally as the compensator tube is subjected to axial loads similar to an elastic band. In some implementations, the compensator tube can also be used with vertical production strings, drill strings, and other wellbore strings subject to changes in length.

It is routine practice to evaluate upper completions and ensure that a tubing-to-packer seal is maintained in the upper completion. However, due to difficulties in accessing and monitoring the state of the lower completions after hydraulic fracturing treatments, little attention has been given to evaluating and addressing issues in lower completions. Recent analysis performed in lower completions have helped determine important parameters such as tubing stresses on individual components of the open hole multistage frac completion, and the impact of these stresses on the various components and pipes. In some cases, the axial stresses in the lower multistage completion string can exceed the tubular strength limits resulting in a twisted pipe or a sheared-off tubing or even loss of zonal isolation. It is imperative to increase the pipe integrity of lower completions and to prevent tubing deformation to facilitate future wellbore intervention with wireline or coiled tubing deployment methods.

Particular implementations of the subject matter described in this specification can be implemented so as to realize one or more of the following advantages. For example, the compensator tube mitigates casing deformation issues resulting from excessive axial loads during well operations (such as hydraulic fracturing). For example, a central function of the compensator tube is to mitigate casing deformation issues resulting from excessive axial loads during well operations (such as hydraulic fracturing). The compensator tube of the present disclosure can be a one-piece tube with no moving parts that can be readily manufactured and be cost effective. Such a tool design can easily be incorporated into the wellbore string and save time making up the completion string while running in hole. Another benefit of the compensator tube is the simplification of operations in comparison to other forms of compensating tools. For example, the compensator tube of the present disclosure can simplify the process of running the compensator tube in hole, simplify the process of spacing out of the compensator tube to accommodate it in the horizontal section of the wellbore, and simplify the "activation" of the tool without the need of pipe manipulation or rotation. The compensator tube sits in the string as a passive tool and simply reacts to axial stresses without the need of physical intervention. A benefit of incorporating short sections of reduced or increased diameter in the compensator tube is that controlled pipe deformation is achieved.

FIG. 1 shows a wellbore assembly 100 implemented in a wellbore 120. The wellbore 120 extends from a ground surface 116 of the wellbore 120 to a downhole end 121 of the wellbore 120. The wellbore 120 is formed in a geologic formation 105 that can include a hydrocarbon reservoir 103 from which hydrocarbons can be extracted. The wellbore assembly 100 can extend from a wellhead 112.

The wellbore assembly 100 includes a wellbore string 102 (e.g., an upper completion string) and a lower openhole multistage completion string 104. The wellbore string 102 extends from the wellhead 112 to an isolation packer assembly 114. The isolation packer assembly 114 lies inside an earlier casing set in the wellbore. The isolation packer assembly 114 can include a liner hanger from which a pipe 113 (e.g., a. liner) of the lower multistage completion string 104 extends.

The open hole multistage completion string 104 is within a non-vertical open hole section 150 of the wellbore 101. The first isolation packer 110*a* and the second isolation packer 110*b* together form an isolated annulus therebetween that extends from the first isolation packer 110*a* to the second isolation packer 110*b*. The lateral openhole section 150 of the wellbore can run anywhere from a couple of hundred feet to thousands of feet in length. The liner 113 is the primary pipe that extends across the lateral and forms the conduit for bringing hydrocarbon to surface from the reservoir.

The lower multistage completion string 104 includes multiple openhole isolation packers 110*a*, 110*b*, 110*c*, and 110*d*. Each pair of adjacent packers form together an isolated annulus therebetween, compartmentalizing the wellbore into pay zones of interest. The lower multistage completion string 104 also includes multiple frac sleeves, each disposed between respective isolation packers which serve as points of access to the formations in selective compartments for hydraulic fracture initiation. For example, the lower multistage completion string 104 can include ball actuated frac sleeves 115 and pressure-actuated frac sleeves 117. The compartments can vary in length from 50 feet intervals to over 1000 feet.

Figure 2A:
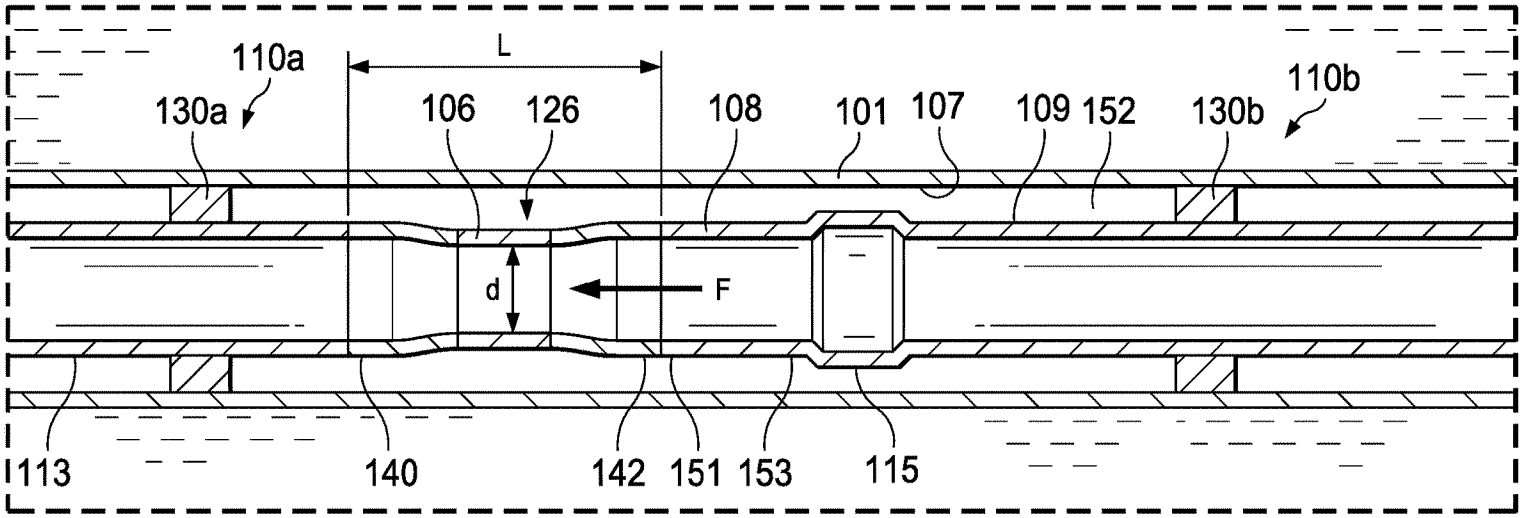
FIG. 2A is a front schematic view of a section of the wellbore assembly indicated in FIG. 1.

Referring also to FIG. 2A, the lower multistage completion string 104 includes a compensator tube 106 disposed between two packers 110*a* and 110*b*. One or more tubes can be disposed between packers 110*a* and 110*b*. For example, only the compensator tube 106 can reside between the two packers 110*a* and 110*b* or, as shown in FIG. 2A, the compensator tube 106 and a second tube or liner 108 and a third tube or liner 109 that reside between the packers 110*a* and 110*b* and can be spaced out between the liner. The compensator tube 106 can reside anywhere between the two packers and tubes 108 and 109. The compensator tube 106 has coupling ends that include a first end 140 (e.g., box end) and a second end 142 (e.g., pin end) opposite the first end where the tube can be connected to the liner 108 or 109. The packers 110*a* and 110*b* include respective sealing elements 130*a* and 130*b* and could include anchors or slips. The packers 110*a* and 110*b* form together an isolated annulus 152. The first packer 110*a* isolates an upper section of the open hole from the isolated annulus 152.

In some implementations, as shown in FIG. 1, a compensator tube 106*b* can also be used as part of an upper completion string. For example, the compensator tube 106*b* can be a tubular section of a continuous wellbore string and can be fixed at one end by the wellhead 112 or by the anchor/packer 114 assembly.

Referring back to FIG. 2A, the first packer 110*a* can prevent substantial movement of the first end 140 of the compensator tube 106 with respect to the wall 107 of the wellbore 101. The second tube 108 has a first end 151 attached to the second end 142 of the compensator tube 106 and a second end 153 attached to the frac sleeve 115. The second packer 110*b* can prevent substantial movement of the second tube 108 (e.g., of the second end 153) and of the third tube 109 with respect to the wall 107 of the wellbore 101. During hydraulic fracturing operations of a particular stage, the two packers on each end ensure the treatment is confined to that stage and zonal isolation is maintained.

The compensator tube 106 can be manufactured as a one-piece tool. To determine the necessary variable length requirements of the compensator tube 106, the axial stresses that the completion assembly 104 is expected to experience can be modeled through simulations or calculations to determine the length changes that can be expected during various operations, particularly the hydraulic fracturing operations.

As depicted in FIG. 2A, the compensator tube can includes a portion of reduced or increased diameter 126. The portion (or the entire tube 106) can be made of expandable metal tubular metallurgy. For example, the tube 106 can be made of a solid expandable tubular (SET) material, EX-80 pipe. As further described in detail below with respect to FIGS. 3 and 4, the compensator tube 106 includes a shape that allows the tube 106 to accommodate changes in length of the liners 108 and 109. For example, the compensator tube 106 can be built with an alloy material different from the mild steel used for the liner 113. The compensator tube can be built of various lengths. For example the compensator tube can have a length 'L' of between, for example, 35 to 40 feet. The special alloy used for the compensator tool gives the tool the ability to deform under stress.

Figure 2B:
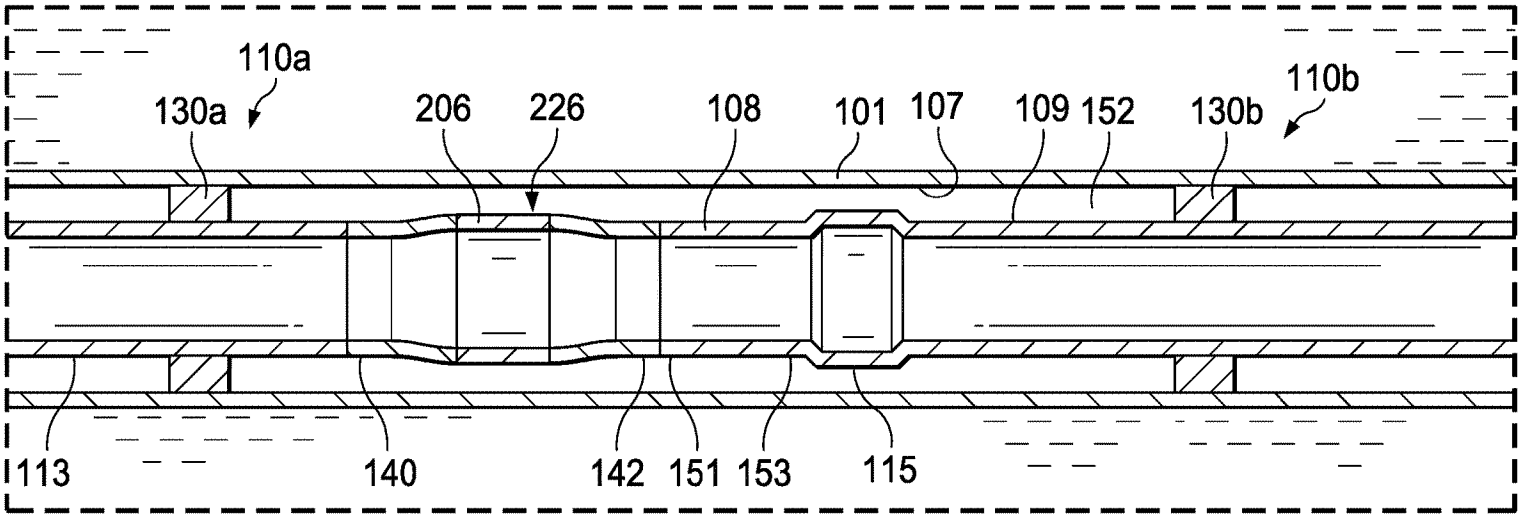
FIG. 2B is a front schematic view of a section of the wellbore assembly according to a different implementation.

As depicted in FIG. 2B, a compensator tube 206 according to a different implementation can include a portion of increased diameter 226 such as an outwardly-projecting annular pleat. Similar to the portion of reduced diameter 126, the portion of increased diameter 226 can change in length to accommodate length variations of the liners 108 and 109.

Referring back to FIG. 2A, the portion or section of reduced diameter 126 can change in diameter to accommodate changes in length of the components disposed between the two packers 110*a* and 110*b* (e.g., the liners 108 and 109). The portion 126 resides between the first end 140 of the compensator tube 106 and the second end 142 of the compensator tube 106. The internal (and external) diameter 'd' of the portion 126 decreases, under a tensile load, to increase an overall length 'L' of the compensator tube 106, accommodating a reduction in length of the second tube 108. The internal (and external) diameter 'd' of the portion 126 increases, under a compressive load, to decrease the length 'L' of the compensator tube 106 to accommodate an increase in length of the second tube 108. In some implementations, the portion 126 can change in diameter to accommodate changes in length of the compensator tube 106. The compensator tube can have a length 'L' of, for example, between 35 and 45 feet (e.g., 40 feet) when implemented in a lower multistage completion string 104. The internal diameter 'd' of the portion 126 is, for example, 3.75 inches and used with a 4.5-inch liner lower completion.

The portion 126 can be or include an inwardly-projecting annular pleat that has a curved wall with a portion diverging toward a center of the curved wall with respect to a direction of a fluid 'F' flowing along the first tube, and a second portion converging away from the center with respect to the direction of the fluid 'F' flowing along the first tube 106. The inwardly-projecting annular pleat bends outwardly under an axial compression load applied by the second tube 108 increasing in length, and bends inwardly under an axial tensile load applied by the second tube 108 decreasing in length.

Figure 3:
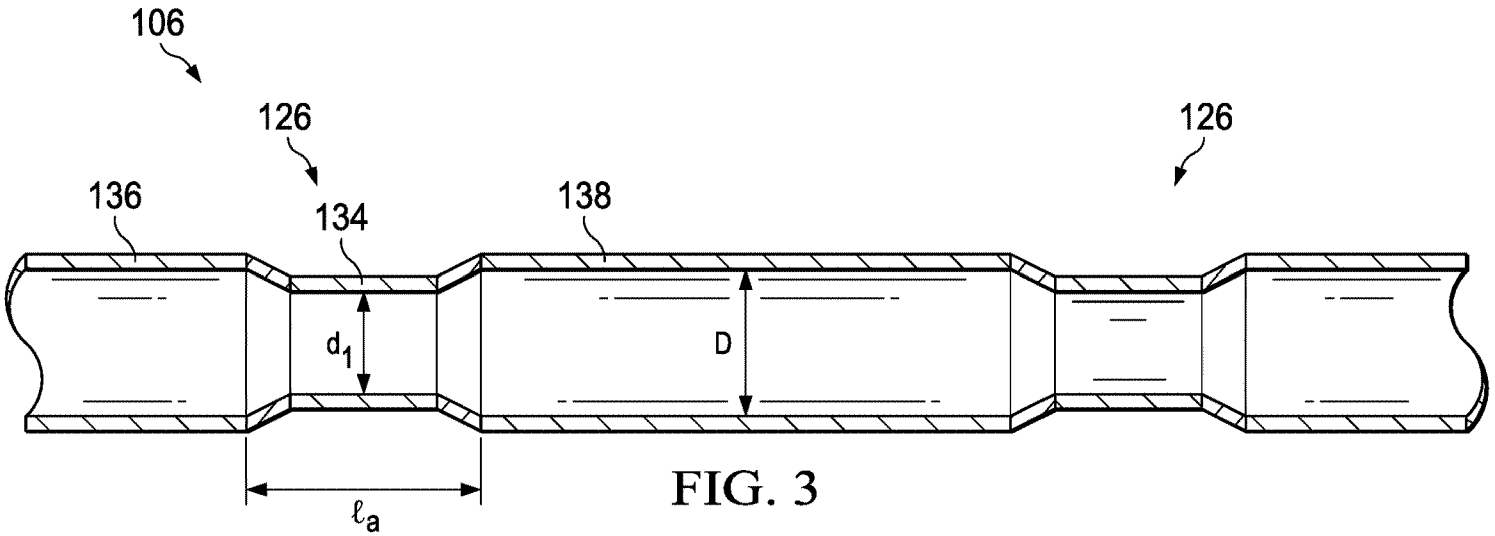
FIGS. 3 and 4 are sequential, front schematic views of a compensator tube under a compression load.
Figure 4:
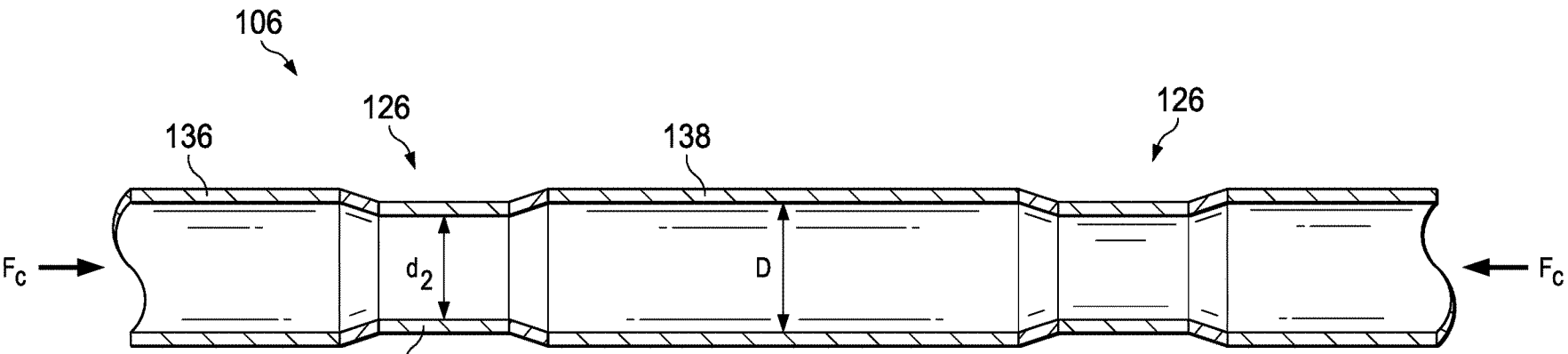
Figure 5:
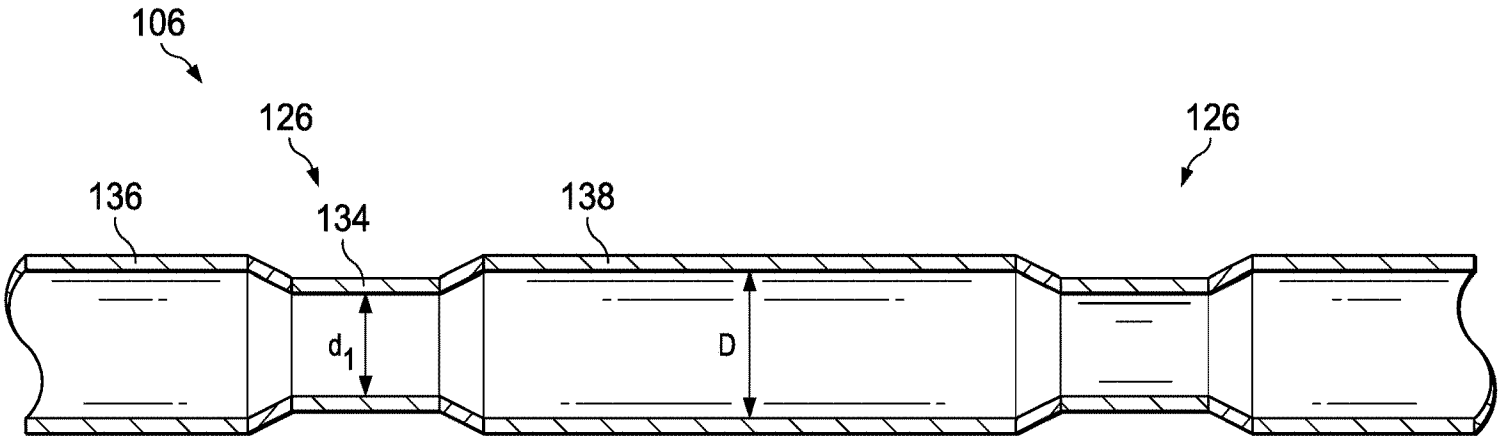
FIGS. 5 and 6 are sequential, front schematic views, of a compensator tube under a tensile load.
Figure 6:
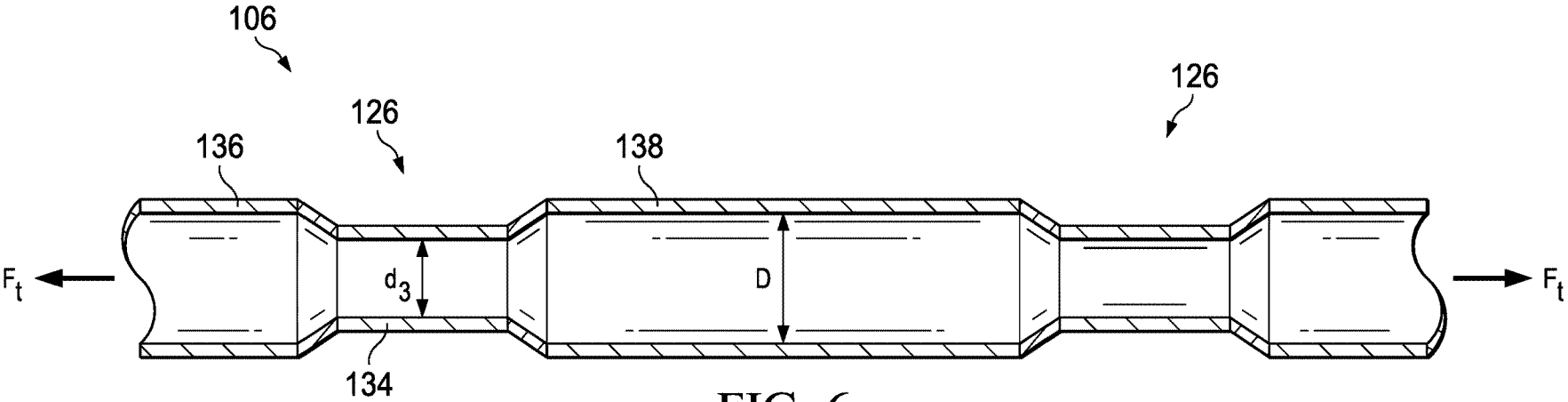

As shown in FIGS. 3 and 4, the compensator tube 106 can have multiple portions 126 of reduced diameter. For example, the tube 106 can have multiple inwardly-projecting annular pleats, multiple outwardly-projecting annular pleats, or a combination of the two. The number of portions 126 of reduced diameter can depend on how much a length compensation the tube 106 is intended to provide. Each portion 126 has a diameter that changes under axial loads. For example, as shown in FIGS. 3 and 4, with the compensator tube 106 under an axial compression load (e.g., when the second tube 108 expands or extends in length), the inner diameter of the portion 126 can increase from about 3.75 inches to an internal diameter '$d_1$' of about 3.83 inches. Such change in diameter can reduce the length of the compensator tube to about 0.1 feet per 5 feet section of portion 126. The more portions 126 in the tube 106, the greater the reduction in length of the tube 106. Conversely, as shown in FIGS. 5 and 6, with the compensator tube 106 under a tensile load (e.g., when the second tube 108 shrinks or retracts), the inner diameter decreases from about 3.75 inches to an internal diameter $d_2'$ of about 3.68 inches. Such change in diameter can increase the length of the compensator tube to about 0.1 feet per 5 feet section of the portion 126.

The reduced internal diameter sections 126 in the compensator tube 106 are designed to function as metal pleats (e.g., made of the same base pipe as the compensator tube) that can be extended or collapsed based on the stress applied to the pleat. It is envisaged the pleats closest to the stress point in the completion string will first react to the stress changes experienced by the completion string compared to any other part of the compensator tube. The following pleats (to the first in the tube) will react to the stress changes in the string until all pleats are 'activated'.

The portion 126 resides between a first tubular wall 136 (e.g., a first tube portion) of the compensator tube 106 and a second tubular wall 138 (e.g., a second tube portion) of the compensator tube 106. The second wall 138 defines a substantially equal inner diameter 'D' than an inner diameter of the first wall 136.

Referring back to FIG. 3, the term "pleats" can refer to minor changes in diameter over short lengths in a joint of pipe. For example, for the section 126 with a length '$l_a$' of about 5.0 feet, and the internal diameter '$d_1$' of section is configured to vary between about 2 and 4%. Consequently, the length '$l_a$' of the compensator tube 106 can vary between about 2 and 4%. For example, under compression, the length 'L' of the tube 106 can decrease by about 0.1-0.2 feet, and under tension the length 'L' of the tube 106 can increase by about 0.1-0.2 feet.

The first annular pleat 130 converges from the first wall 136 toward the third tube 134, and the second annular pleat 132 diverges from the third tube 134 toward the second wall 138. The annular pleats form, together with the third tube 134, a slight 'throat' that does not substantially change the pressure of the fluid at the throat.

In some implementations, the compensator tube 106 may have a single internal diameter across the whole tool. Since the tool is made from expandable metallurgy, it can change in diameter to accommodate changes in length of the components disposed between the two packers 110*a* and 110*b* (primarily the liner itself denoted as tube 108). The diameter of the compensator tube 106 would decrease to reduce an overall length of the compensator tube 106, accommodating an increment in length of the second tube 108 and vice versa. The compensator tool can be built of various lengths but a typical length can be a joint of pipe 35 feet to 40 feet in length. The special alloy used for the compensator tool gives the tool the ability to preferentially deform under stress.

The term "substantially equal" refers to a relation between two elements (e.g., lines, axes, planes, surfaces, or components) as having generally the same dimension within acceptable engineering, machining, drawing measurement, or part size tolerances such that their differences are minimal. The term "prevent substantial movement" refers to preventing movement that would otherwise compromise the integrity of the seal or of the downhole assembly.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly comprising:

a first tube configured to be disposed within a wellbore, the first tube comprising a first end arranged to be fixed against substantial movement with respect to a wall of the wellbore; and a second tube coupled to a second end of the first tube opposite the first end, forming a coupling with the first tube, the second tube comprising a third end opposite the coupling, the third end arranged to be fixed against substantial movement with respect to the wall of the wellbore;

wherein the first tube comprises a portion of reduced or increased diameter residing between the first end and the second end, the portion of reduced or increased diameter defining an internal diameter configured change, with the first tube under a compression load, to decrease a length of the first tube, and the internal diameter configured to change, with the first tube under a tensile load, to increase a length of the first tube such that the portion of reduced or increased diameter accommodates changes in length of the first tube or the second tube or both.

2. The wellbore assembly of claim 1, wherein the portion of reduced or increased diameter comprises a portion of reduced diameter, the internal diameter configured to increase, with the first tube under a compression load, to decrease a length of the first tube, and the internal diameter configured to decrease, with the first tube under a tensile load, to increase a length of the first tube.

3. The wellbore assembly of claim 1, wherein the portion of reduced or increased diameter is disposed between a first wall of the first tube and a second wall of the first tube, the second wall defining a substantially equal inner diameter than an inner diameter of the first wall, the portion of reduced or increased diameter configured to bend under axial stress to reduce or increase the length of the first tube.

4. The wellbore assembly of claim 3, wherein the first wall and the second wall comprise an internal diameter configured to remain substantially constant during changes in length of the first tube.

5. The wellbore assembly of claim 1, wherein the portion of reduced or increased diameter comprises an inwardly-projecting annular pleat configured to bend outwardly under an axial compression load applied by the second tube increasing in length, and the inwardly-projection annular pleat configured to bend inwardly under an axial tensile load applied by the second tube decreasing in length.

6. The wellbore assembly of claim 5, wherein the inwardly-projecting annular pleat comprises a length configured to change, under axial stress, between 2% and 4%, and the internal diameter of the annular pleat is configured to vary between 2% to 4%.

7. The wellbore assembly of claim 5, wherein the first tube comprises a plurality of inwardly-projecting annular pleats arranged along a length of the first tube, each inwardly-projecting annular pleat comprising a respective variable diameter to change a length of the first tube.

8. The wellbore assembly of claim 5, wherein the inwardly-projecting annular pleat comprises a curved wall with a portion diverging toward a center of the curved wall with respect to a direction of a fluid flowing along the first tube, and a second portion converging away from the center with respect to the direction of the fluid flowing along the first tube.

9. The wellbore assembly of claim 1, wherein the portion of reduced or increased diameter is made of a metal comprising an expandable tubular metallurgy.

10. The wellbore assembly of claim 1, further comprising a first packer configured to be coupled to the first end of the first tube and a second packer configured to be coupled to the third end of the second tube, the first packer configured to isolate, with the second packer, an annulus defined between the first packer and the second packer from a wellbore annulus uphole of the first packer, the first packer configured to fix the first end of the first tube to the wall of the wellbore and the second packer configured to fix the third end of the second tube to the wall of the wellbore.

11. The wellbore assembly of claim 10, wherein the first packer comprises a first open hole isolation packer, the second packer comprises a second open hole isolation packer, and the first tube and the second tube are part of an open hole multistage completion string, the second tube coupled, though a frac sleeve of the open hole multistage completion string, to the second end of the first tube.

12. The wellbore assembly of claim 11, wherein the open hole multistage completion string is configured to be disposed within a non-vertical section of the wellbore, each of the first open hole isolation packer and the open hole second isolation packer configured to be set on an open hole portion of the non-vertical section of the wellbore to prevent the respective ends of the first tube and the second tube from substantially moving with respect to the wall of the wellbore.

13. The wellbore assembly of claim 1, wherein the first tube comprises a plurality of portions of reduced or increased diameter, one of the plurality of portions of reduced or increased diameter comprising an inwardly-projection pleat, and one of the plurality of portions of reduced or increased diameter comprising an outwardly-projecting pleat.

14. A method comprising:

obtaining a wellbore assembly comprising, a first tube configured to be disposed within a wellbore, the first tube comprising a first end and a second end opposite the first end, the first tube comprising a portion of reduced or increased diameter residing between the first end and the second end, the portion of reduced or increased defining an internal diameter configured change, under an axial load, to change a length of the first tube, and a second tube;

coupling the first tube to the second tube;

deploying the first tube and the second tube to a downhole section of a wellbore; and setting the first tube and the second tube on the wall of the wellbore such that the first tube changes in length, upon being subject to an axial load applied at the first end and an opposite axial load applied at the second end by the second tube changing in length.

15. The method of claim 14, wherein setting the first tube and the second tube on the wall comprises setting a first packer and a second packer on the wall of the wellbore, the first packer coupled to the first tube and the second packer coupled to the second tube, the first tube configured to decrease in length under an axial compression load applied by the second tube increasing in length, and the first tube configured to increase in length under an axial tensile load applied by the second tube decreasing in length.

16. The method of claim 15, wherein the first packer comprises a first open hole isolation packer, the second packer comprises a second open hole isolation packer, and the first tube and the second tube are part of an open hole multistage completion string, and coupling the first tube to the second tube comprises coupling the first tube to first end of a frac sleeve and coupling the second tube to a second end of the frac sleeve.

17. The method of claim 16, wherein setting the first packer and the second packer comprises setting the first packer on a non-vertical, open hole section of the wellbore and setting the second packer on the non-vertical, open hole section of the wellbore.

18. The method of claim 14, wherein the inwardly-projecting annular pleat and the internal diameter of the annular pleat is configured to vary between 2% to 4%, and setting the first tube on the wall of the wellbore comprises setting the tube such that the annular pleat varies in length between 2% to 4% under axial stress applied by the second tube changing in length.

19. The method of claim 14, wherein the first tube comprises a plurality of portions of reduced or increased diameter, one of the plurality of portions of reduced or increased diameter comprising an inwardly-projection pleat, and one of the plurality of portions of reduced or increased diameter comprising an outwardly-projecting pleat, and setting the first tube on the wall of the wellbore comprises setting the tube such that the first tube varies in length between 2% to 4% per pleat under axial stress applied by the second tube changing in length.

20. A wellbore assembly comprising:

an upper completion string configured to be disposed within a wellbore; and a lower completion string coupled to a downhole end of the upper completion string and configured to be disposed at least partially within an open hole of the wellbore, the lower completion string comprising:

a compensator tube comprising a first end configured to be attached, by a packer, to a wall of the wellbore; and a lower completion tube coupled to a second end of the first tube opposite the first end, the lower completion tube configured to be attached to the well of the wellbore by a second packer;

wherein the compensator tube comprises a portion of reduced or increased diameter residing between the first end and the second end, the portion of reduced or increased diameter defining an internal diameter configured to change, with the compensator tube under an axial compression load caused by a change in length of the lower completion tube, decreasing a length of the compensator tube, and the internal diameter configured to change, with the compensator tube under an axial tensile load caused by a change in length of the lower completion tube, increasing a length of the compensator tube such that the compensator tube accommodates changes in length of the lower completion tube.

* * * * *